US011072833B2

(12) United States Patent
Kang et al.

(10) Patent No.: US 11,072,833 B2
(45) Date of Patent: Jul. 27, 2021

(54) WET LEATHER STRETCHING DEVICE

(71) Applicant: KORONA CORPORATION, Busan (KR)

(72) Inventors: Tae Jun Kang, Gimhae-si (KR); Kee Tak Kang, Busan (KR)

(73) Assignee: KORONA CORPORATION, Busan (KR)

( * ) Notice: Subject to any disclaimer, the term of this patent is extended or adjusted under 35 U.S.C. 154(b) by 49 days.

(21) Appl. No.: 16/658,874

(22) Filed: Oct. 21, 2019

(65) Prior Publication Data

US 2020/0149123 A1 May 14, 2020

(30) Foreign Application Priority Data

Nov. 8, 2018 (KR) ..... 10-2018-0136441

(51) Int. Cl.
*C14B 1/26* (2006.01)
*C14B 1/02* (2006.01)

(52) U.S. Cl.
CPC ..... *C14B 1/26* (2013.01); *C14B 1/02* (2013.01); *C14B 2700/07* (2013.01)

(58) Field of Classification Search
CPC .... C14B 1/26; C14B 1/58; C14B 1/60; C14B 17/04; C14B 2700/07; C14B 2700/12
See application file for complete search history.

(56) References Cited

U.S. PATENT DOCUMENTS 2,233,495 A * 3/1941 Sterling ..... C14B 1/30 69/47
2,358,334 A * 9/1944 Knowlton ..... C14B 1/44 69/37
3,727,437 A * 4/1973 Dokoupil ..... C14B 1/44 69/48
3,872,695 A * 3/1975 Busek ..... C14B 1/00 69/47
4,055,059 A * 10/1977 Dokoupil ..... B30B 9/246 69/41

(Continued)

FOREIGN PATENT DOCUMENTS

EP 0288264 A2 * 10/1988 ..... C14B 1/40
JP 3124817 1/2001

(Continued)

*Primary Examiner* — Shaun R Hurley
(74) *Attorney, Agent, or Firm* — Kile Park Reed & Houtteman PLLC

(57) ABSTRACT

The present invention provides a wet leather stretching device, including a second bracket (12) provided with a mechanism for adjusting tension of a first belt (17), wherein the mechanism includes: a movable plate (41) coupled to each of left and right side surfaces of the second bracket (12); a support plate (31) coupled to one surface of each movable plate (41); a cylinder (32) having a lower part fixedly coupled to a lower part surface of each support plate (31); a rod (33) protruding a certain length through an upper part of each cylinder (32); a guide end (35) provided on one surface of the movable plate (41) at a distance above the support plate (31); a guide plate (36) connected to the rod (33) and contacting with the guide end (35), and a movable pipe (37) with a predetermined length contacting with the first belt (17).

4 Claims, 5 Drawing Sheets

(56) References Cited

U.S. PATENT DOCUMENTS

| | | | | | |
|---|---|---|---|---|---|
| 4,100,773 | A * | 7/1978 | Repetto | B30B 9/24 | 100/118 |
| 4,475,453 | A * | 10/1984 | Davis | B30B 9/246 | 100/118 |
| 4,507,943 | A * | 4/1985 | Viljanmaa | C14B 1/26 | 69/41 |
| 4,643,916 | A * | 2/1987 | Kiuchi | B29D 29/00 | 156/137 |
| 4,888,966 | A * | 12/1989 | Zapfel | C14B 1/34 | 69/41 |
| 5,184,487 | A * | 2/1993 | Corner | C14B 1/40 | 69/19.1 |
| 6,112,559 | A * | 9/2000 | Zanette | C14B 1/40 | 69/19.1 |
| 6,854,301 | B1 * | 2/2005 | Romanski | C14B 1/34 | 69/48 |

FOREIGN PATENT DOCUMENTS

| | | |
|---|---|---|
| KR | 10-2001-0014454 | 2/2001 |
| KR | 10-2005-0100762 | 10/2005 |
| KR | 10-2009-0123219 | 12/2009 |
| KR | 10-2011-0130780 | 12/2011 |
| KR | 10-1208589 | 12/2012 |
| KR | 10-2014-0005068 | 1/2014 |
| KR | 10-1779996 | 9/2017 |

* cited by examiner

WET LEATHER STRETCHING DEVICE

CROSS REFERENCE TO RELATED APPLICATION

The present application claims priority to Korean Patent Application No. 10-2018-0136441, filed Nov. 8, 2018, the entire contents of which is incorporated herein for all purposes by this reference.

BACKGROUND OF THE INVENTION

Field of the Invention

The present invention relates to a wet leather stretching device. More specifically, the present invention relates to a wet leather stretching device in which belts may stably perform functions for a long time in a working process. By providing a tension control mechanism with drying function, it is possible to actively cope with a phenomenon that tension of the belts changes as moisture is transferred to the belts during a flattening operation of the leather containing moisture.

Description of the Related Art

The wet leather stretching device softens wet leather and at the same time, makes the leather surfaces flat. A conventional wet leather stretching device is operated in a method that while passing the leather 80 between belts 70 positioned up and down thereof, simultaneously using pin plates (not shown) provided on the upper or lower part of the belt 70, the device works by pounding the belt 70 together with the leather 80 as shown in FIG. 5.

However, when the belts are pounded together with the leather by the pin plates, the leather is flattened and dehydrated at the same time. The belts absorb moisture released from the leather, and weight of the belts is increased. An increase in the weight of the belts due to moisture absorption contributes as a factor causing a reduction in the tension of the belts. Consequently, regular transfer of the leather becomes difficult, and the leather itself is damaged during a flattening process.

In order to solve this problem, the related industry proposes a variety of ways to provide a means for correctly adjusting the tension of the belts. However, a more fundamental solution is desperately required because the structure of the proposition is very complicated, and the moisture transferred from the leather is a primary cause of the tension change of the belts.

Documents of Related Art (Patent Document 1) Korean Patent Application Publication No. 10-2001-0014454

(Patent Document 2) Korean Patent Application Publication No. 10-2011-0130780

SUMMARY OF THE INVENTION

The present invention is proposed in order to solve the problems of the related art, and an objective of the present invention is to provide a wet leather stretching device that may adequately cope with a case where moisture changes tension of belts during a flattening process for leather.

In order to accomplish the above object, the present invention provides a wet leather stretching device including:

a stand part 5 provided with an up-and-down vibration block 6; first and second brackets 11, 12 respectively provided on left and right upper parts of the stand part 5; first and second lower rollers 13, 14 respectively disposed on the first and second brackets 11, 12; a head part 2 spaced apart from the up-and-down vibration block 6 by a predetermined distance; first and second upper rollers 21, 22 respectively provided on left and right sides of the head part 2; a first belt 17 moving in orbit between the first and second lower rollers 13, 14 while maintaining constant tension; a second belt 27 moving in orbit between the first and second upper rollers 21, 22 while maintaining constant tension and facing the first belt 17; a first pressing plate 18 provided with a plurality of pressure pins to tightly press against a lower surface of the first belt 17 in a state of being exposed through an upper surface of the up-and-down vibration block 6; and a second pressing plate 28 provided with a plurality of pressure pins to tightly press against an upper surface of the second belt 27 in a state of being exposed through a lower surface of the head part 2, wherein the second bracket 12 is provided with a mechanism for adjusting tension of the first belt 17, and the mechanism for adjusting the tension includes: a pair of movable plates 41, each coupled to each of left and right side surfaces of the second bracket 12; a pair of support plates 31, each coupled to one surface of each movable plate 41; a pair of cylinders 32, each having a lower part fixedly coupled to one surface of a lower part of each support plate 31; a pair of rods 33, each protruding a certain length through an upper part of each cylinder 32; two pairs of guide ends 35, each pair provided on one surface of the movable plate 41 at a predetermined distance above each support plate 31; a pair of guide plates 36, each having a lower part connected to each rod 33, and having left and right side parts contacted with the guide end 35; and a movable pipe 37 with a predetermined length, while being in contact with the first belt 17, the movable pipe 37 having both end parts rotatably coupled to one guide plate 36 and the other guide plate 36 respectively.

A plurality of through-holes 371 may be provided in the movable pipe 37, and any one of the guide plates 36 may be connected to an air supply pipe 38 communicating with an end of the movable pipe 37.

At this time, both end parts of each of the second lower roller 14 and the second upper roller 22 may provided to be spaced apart from each other on an upper part of each movable plate 41, first and second guide holes 122, 123 having a predetermined length and positioned at different vertical heights may be provided on each the left and right side surfaces of the second bracket 12, third and fourth through-holes 42, 43 having a predetermined length and positioned at different vertical heights may be provided on each of the movable plates 41 in correspondence to each of the first and second guide holes 122, 123, and each movable plate 41 may be adjusted by a predetermined width in forward and backward directions on each of the left and right side surfaces of the second bracket 12 by each of first and second fastening pins 44, 45 and may be coupled to the second bracket 12.

The present invention enables to continuously perform a flattening work on leather without interruption by providing a means for adjusting tension of a lower belt only or both of upper and lower belts when weight of the belts increases due to moisture transferred from leather. In addition, the belts may be dried using external air, making the tension adjustment of the belts more convenient, and also allowing the belts to stably perform functions for a very long time.

DETAILED DESCRIPTION OF THE INVENTION

Referring to the preferred embodiment of the present invention with reference to the accompanying drawings, a detailed description is as follows. In describing an exemplary embodiment of the present invention, when there is no direct relationship with the technical features of the present invention, or when matters self-evident to those skilled in the art to which the present invention pertains are exist, a detailed description thereof will be omitted.

Figure 1:
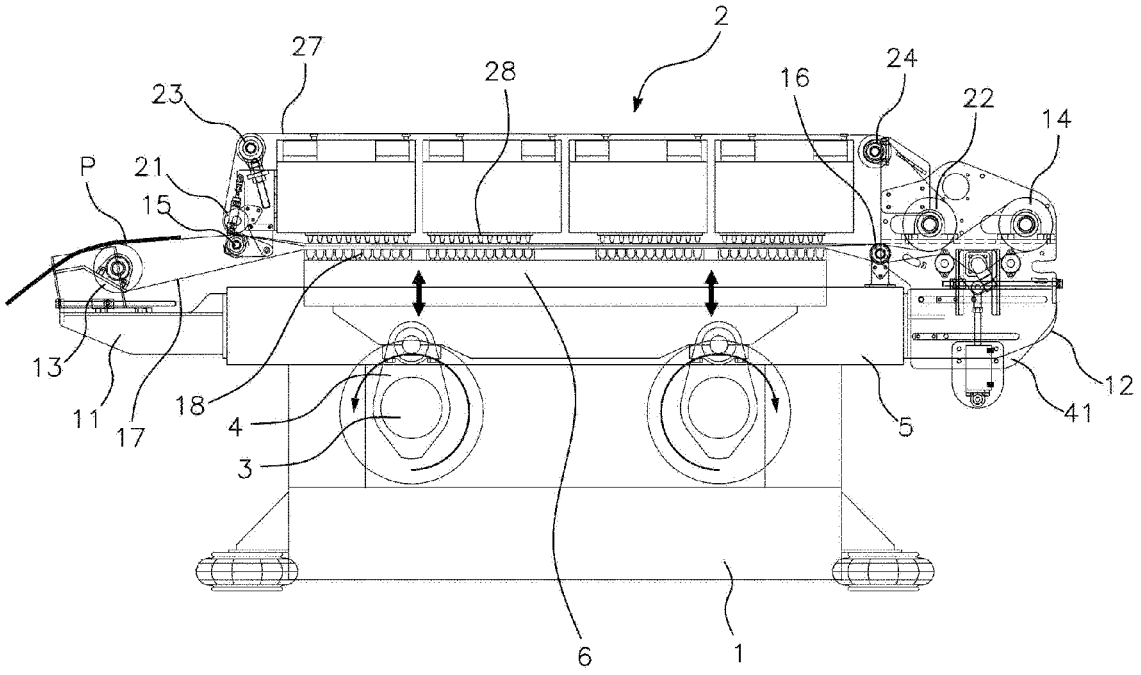
FIG. 1 is a schematic configuration diagram of a wet leather stretching device according to the present invention.

FIG. 1 is a schematic configuration diagram of a wet leather stretching device according to the present invention. As shown in the drawings, the present invention has technical features provided with a stand part 5, a head part 2, a lower roller and an upper roller, first and second belts 17 and 27, first and second pressing plates 18 and 28, and tension adjustment means. Hereinafter, each of these components will be described in detail.

The stand part 5 supports an entire device and is a part in which work on leather P is performed. A lower part of the stand part is provided with a support part 1 and an upper part of the stand part is provided with an up-and-down vibration block 6. A plurality of driving motor (not shown) and the like is provided in the space between the support part 1 and the stand part 5. Reference numeral 3 and 4 each represent an eccentric cam and a movable rod. The eccentric cam is connected to the main shaft not shown. The rotational movement of the eccentric cam is converted into a vertical reciprocating motion through the movable rod.

First and second brackets 11 and 12 are provided at left and right upper parts of the stand part 5. Each of the first and second brackets 11 and 12 do functions as an installation end and a support end of rollers. The lower roller includes first and second lower rollers 13 and 14 respectively provided on the first and second brackets 11 and 12. The upper roller may include first and second upper rollers 21 and 22 provided on the left and right sides of the head part 2. Reference numeral 15 and 16 respectively denote third and fourth lower rollers, and reference numeral 23 and 24 respectively denote third and fourth upper rollers.

At this time, each of the second lower roller 14 and the second upper roller 22 may be provided on a movable plate 41 provided on each of the left and right side surfaces of the second bracket 12 and move together by a predetermined distance. The details thereof will be described later.

A first belt 17 maintains constant tension and tracks the first, second, third, and fourth lower rollers 13, 14, 15, and 16 in orbit. The second belt 27 maintains constant tension in a state opposite to the first belt 17, and tracks the first, second, third and fourth upper rollers 21, 22, 23 and 24 in orbit. An interval between the first and second belts 17 and 27 may vary depending on the leather P which is targeted for work.

The first pressing plate 18 is arranged on the up-and-down vibration block 6 to tightly press against a lower surface of the first belt 17, and the second pressing plate 28 is in an exposed state through a lower surface of the head part 2 to tightly press against an upper surface of the second belt 27. Each of the first and second pressing plates 18 and 28 is provided with a plurality of pressure pins.

When rotational motion of the eccentric cam 3 is converted to linear reciprocating motion of a movable rod 4 as shown in FIG. 1 and transmitted to the first pressing plate 18 through the up-and-down vibration block 6, the leather P moving between the first and second belts 17 and 27 is compressed by the plurality of pressure pins, and thus moisture contained in the leather P is removed and the leather P is in a flat state while moving between the first and second belts 17 and 27.

Figure 2:
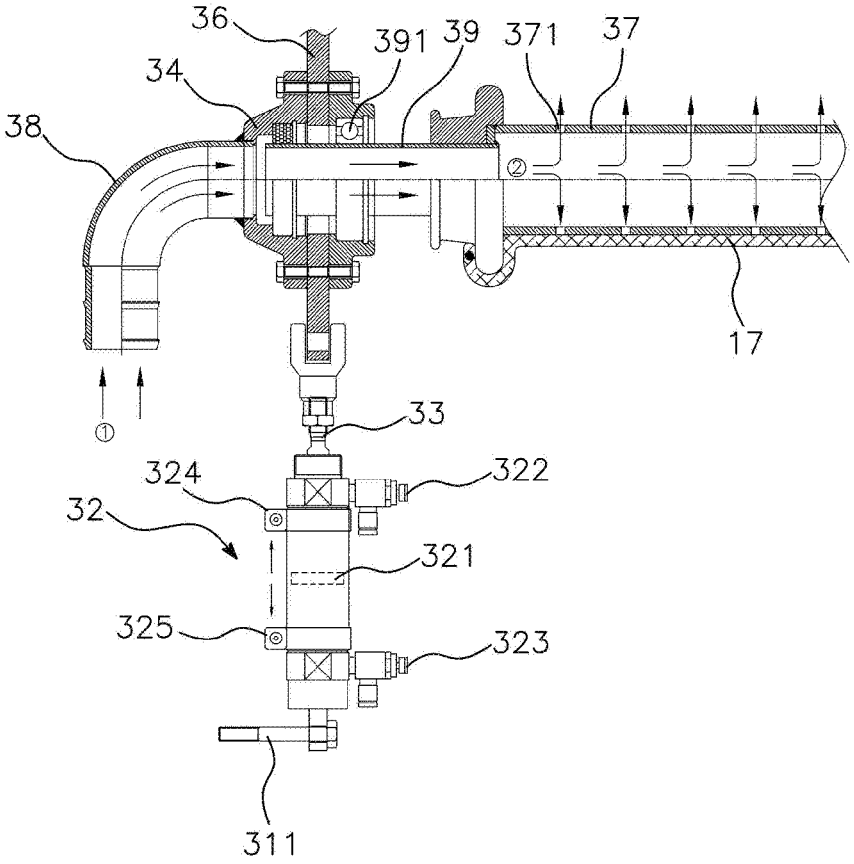
FIG. 2 is a schematic diagram of a tension and drying mechanism in the wet leather stretching device according to the present invention.
Figure 3:
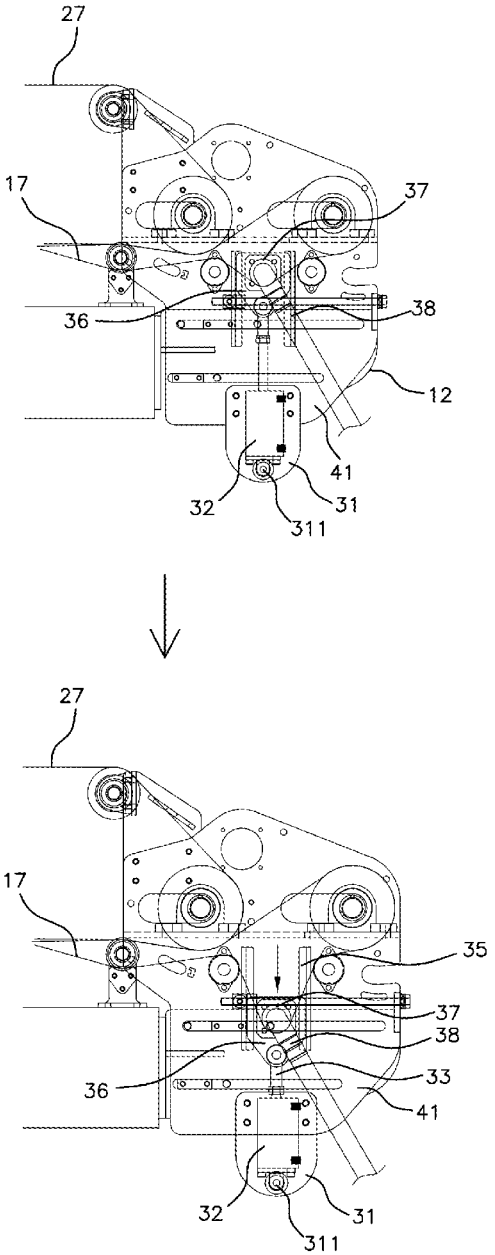
FIGS. 3 and 4 are each a schematic block diagram illustrating a tension control state of the belts in the wet leather stretching device according to the present invention.

Here, the present invention proposes a case in which a mechanism capable of appropriately adjusting the tension of the first belt 17 is provided, as respectively disclosed in FIGS. 2 and 3. A tension control mechanism according to the present invention may include the movable plate 41, a support plate 31, a cylinder 32, a rod 33, a guide end 35, a guide plate 36, and a movable pipe 37. Hereinafter, these components composing the tension control mechanism will be described.

The movable plate 41 is made of a plate-like structure having a predetermined area, and composes of a pair of left and right respectively coupled to each of the left and right side surfaces of the second bracket 12. In the drawings, an example of the movable plate 41 coupled to the left side surface of the second bracket 12 is disclosed, from among the pair of the left and right movable plates 41 respectively coupled to each of the left and right side surfaces of the second bracket 12.

The support plate 31 is made of a plate-like structure having a predetermined area, and is coupled to one surface of a lower part of each of the movable plates 41. A lower part of the cylinder 32 is fixedly coupled to one surface of each of the support plates 31. Reference numeral 311 is a fixing rod for fixing the lower part of the cylinder 32 to the support plate 31.

Here, the cylinder 32 is operated by air pressure, reference numeral 321 is a horizontal plate connected to the rod 33, and reference numeral 322, 323 are first and second air injection porters, respectively. When air is injected into the first air injection porter 322, the rod 33 is lowered as the horizontal plate 321 descends to the bottom of the cylinder. Also, when the air is injected into the second air injection porter 323, the rod 33 is raised as the horizontal plate 321 ascends to the top of the cylinder.

In addition, reference numeral 324 and 325 are each of first and second detection sensors, and the first detection sensor 324 is a means for limiting the maximum rise height (top dead center) of the horizontal plate 321. Also, the second detection sensor 325 is a means for limiting the minimum descent height (bottom dead center) of the horizontal plate 321. In other words, when the horizontal plate 321 reaches the top dead center or the bottom dead center, signals of the first and second detection sensors 324 and 325 are sent to stop the operation of the cylinder 32.

The rod 33 protrudes a certain length through an upper part of each cylinder 32. The guide end 35 is provided on one surface of the movable plate 41 at a predetermined distance in an upper direction of each of the support plates 31. The guide end 35 is composed of a pair of left and right guide end facing each other, as shown in FIG. 3.

A lower part of the guide plate 36 is connected to each rod 33, and each of the left and right parts of the guide plate is in contact with an inner bending end (not shown) of each of the guide ends 35. When the rod 33 moves up and down, the guide plate 36 is guided by the guide end 35 to move up and down. The inner bending end of the guide end 35 may be provided to have a cross-section of an L-shape structure so that parts on both sides of the guide plate 36 are guided in an inserted state.

Each of the both ends of the movable pipe 37 is rotatably coupled to one side of the guide plate 36 and the other side of the guide plate 36 respectively, and is in contact with the first belt 17 that maintains constant tension. Reference numeral 34 is a support frame penetratingly coupled to each of the guide plates 36, and reference numeral 39 is a connecting pipe connecting the support frame 34 to the movable pipe 37.

In other words, one end part of the connecting pipe 39 is inserted through the support frame 34, and the other end part of the connecting pipe 39 is connected to the end part of the movable pipe 37. Reference numeral 391 denotes a rolling bearing. When the movable pipe 37 is driven to rotate together according to movement of the first belt 17, the connecting pipe 39 rotates together with the movable pipe 37 supported by the support frame 34 according to rolling motion of the rolling bearing 391.

On the other hand, the present invention proposes a case where each movable pipe 37 is provided with a plurality of through-holes 371, and an air supply pipe 38 which supplies air is connected to any one of the guide plates 36 to which the movable pipe 37 is connected, as disclosed in FIG. 2. The outside air introduced through the air supply pipe 38 is supplied to the first belt 17 through the through-holes 371 of the movable pipe 37.

Air supply through the air supply pipe 38 may be made by the operation of the pump not shown, or by connecting the air supply pipe 38 with a high pressure air tank or a high pressure blower and providing a separate valve in the air supply pipe as well.

In addition, in a case where the movable plate 41 is coupled to the second bracket 12, the present invention does not exclude a case in which each of the movable plates 41 is made of a configuration that a distance may be adjusted by a predetermined width in forward and backward directions on the second bracket 12.

To this end, first and second through-holes 46 and 47 that are spaced apart from each other at regular intervals are provided at upper parts of the movable plates 41. Also, first and second guide holes 122 and 123 and third and four through-holes 42 and 43, each one having a predetermined length, are respectively provided at different vertical heights in a lower parts of the left and right side surfaces of the second bracket 12 and in a lower parts of the movable plates 41.

Accordingly, both end parts of each of the second lower roller 14 and the second upper roller 22 are rotatably coupled to each of the movable plates 41 through the first and second through-holes 46 and 47. In addition, each of the first and second guide holes 122 and 123 of the second bracket 12 and the third and fourth through-holes 42 and 43 of the movable plate 41 are respectively interconnected by each of first and second fastening pin 44 and 45.

In the latter case, when it is necessary to adjust a forward and backward distance of each of the movable plates 41 with respect to the second bracket 12, each of the movable plates 41 is moved a predetermined distance forward or backward with respect to the second bracket 12 and then each of the movable plates 41 is fixedly coupled to the second bracket 12 by the first and second fastening pins 44 and 45, so that a position of each of the movable plates 41 with respect to the second bracket 12 is fixed.

A schematic operational configuration of the present invention having such a configuration is described with reference to the above mentioned description and the accompanying drawings.

When the wet leather stretching device is operated according to the operation of the controller, the first and second belts 17 and 27 are in orbital motion, and in this state, the leather P held by the worker is placed on an upper surface of the first belt 17. When leather P is placed on the upper surface of the first belt 17, according to the movement of the first belt 17, the leather P enters between the first and second pressing plates 18 and 28 while being inserted between the first and second belts 17 and 27.

When the leather P enters between the first and second pressing plates 18 and 28 by the first and second belts 17 and 27, rotational motion by the eccentric cam 3 is converted into linear motion of the movable rod 4, and the first pressing plate 18 continuously pounds the leather P inserted and moved between the first and second belts 17 and 27 by the linear motion of the movable rod 4. Accordingly, the leather P is flattened by pressing force between the first and second pressing plates 18 and 28.

Since the leather P inserted and moved between the first and second belts 17 and 27 holds a certain amount of moisture, when pressing force between the first and second pressing plates 18 and 28 acts on the leather P whereby the leather P is pressurized, the moisture contained in the leather P is transferred to the first and second belts 17 and 27. At this time, the moisture delivered to the belts is further accumulated in the first belt 17. Since the main component of the belt is an elastic fiber material, the belts are stretched by weight that is increased due to the moisture absorbed from the leather.

In other words, the first belt has tension that naturally decreases by an increased length of itself when stretched. In this case, the present invention may adjust the tension of the belts in any of the following manners.

First, a case in which only the tension of the first belt 17 is adjusted is to be described. This may be performed by injecting high pressure air through the first air injection porter 322 in FIG. 2. When high pressure air is injected through the first air injection porter 322, the horizontal plate 321 is moved downward, and thus the rod 33 connected to the horizontal plate 321 is also pulled downward for a certain distance.

When the rod 33 is pulled downward by a predetermined distance, the movable pipe 37 disposed at a position of the top dead center as shown in an upper side of FIG. 3 gradually descends. In addition, as the movable pipe 37 descends, the first belt 17 that is in contact with the movable pipe 37 also descends together. When the lowering of the horizontal plate 321 is detected by the second detection sensor 325, injection pressure of high pressure air through the first air injection porter 322 is kept constant.

Accordingly, the lowering of the rod 33 is stopped, and each of the movable pipe 37 and the first belt 17 stops being lowed, and maintains a position of bottom dead center as shown in a lower side of FIG. 3. That is, the tension of the first belt 17 is increased by more than a predetermined value by the length in which the first belt is extended to cope with the change in self-weight due to the absorption of water.

Returning to the original position of the first belt may be performed conversely to the above mentioned process by injecting air through the second air injection port and operating the first detection sensor 324.

Figure 4:
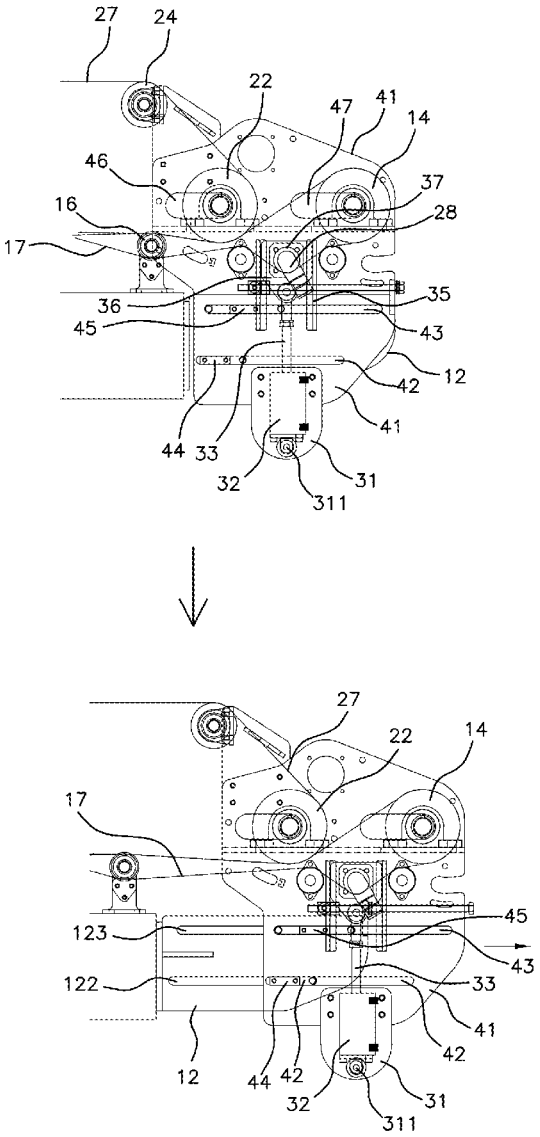
Figure 5:
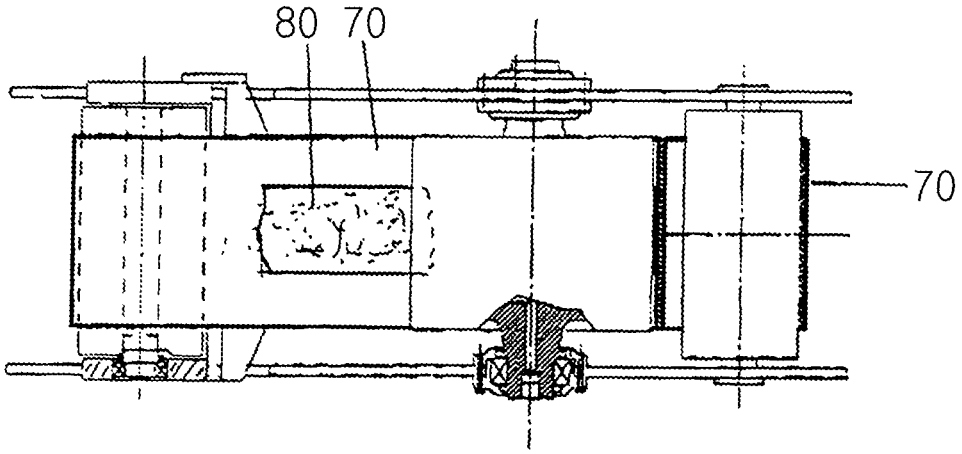
FIG. 5 (Prior Art)
FIG. 5 is a schematic configuration diagram of a conventional wet leather stretching device.

Next, a case in which the tension of each of the first and second belts 17 and 27 is simultaneously adjusted is to be described. This may be done in such a way that each of the movable plates 41 is moved a predetermined distance backward from the point where the first movable plate 41 is to first coupled to the second bracket 12 as shown in FIG. 4. First, each of the first and second fastening pins 44 and 45 is separated.

When each of the first and second fastening pins 44 and 45 is separated, each of the movable plates 41 is separated from the second bracket 12, and in this state, each of the movable plates 41 is moved a predetermined distance backward. At this time, each of the movable plates 41 positioned on each of the left and right side surfaces of the second bracket 12 is repositioned by moving the same distance.

When each of the movable plates 41 is moved backward by a predetermined distance, each of the movable plates 41 is fixedly coupled to the second bracket 12 by fastening again each of the first and second fastening pins 44 and 45 separated as shown in a lower side of FIG. 4. Accordingly, since each of the second lower and upper rollers 14 and 22, which are in contact with each of the first and second belts 17 and 27, moves a predetermined distance from an initial position to the backward direction, the tension of each of the first and second belts 17 and 27 is also increased by a predetermined value or more, and thus it is possible to cope with a change in the self-weight due to the absorption of water.

In adjusting the tension of the belts according to the present invention, a combination of the two methods disclosed in each of FIGS. 3 and 4 may be used. In other words, as shown in a lower part of FIG. 4, while in a state that each of the movable plates 41 is moved backward by a certain distance to simultaneously increase the tension of each of the first and second belts 17 and 27, a method may be applicable to increase the tension of the first belt 17 by operating the cylinder 32 as shown in a lower part of FIG. 3. In this case, the tension of the first belt may be adjusted to an appropriate value.

In addition, the present invention may perform a step before adjusting the tension of the belt by applying the tension control mechanism, or perform a step of dehydrating or drying on the first belt 17 by supplying the outside air to the first belt 17 through the air supply pipe 38 with the operation of the tension control mechanism. That is, by injecting high pressure air into the first belt 17, the moisture contained in the first belt 17 is forcibly dehydrated or dried. In this case, the tension adjustment of the belts may be made more easily, as well as to allow the belts to stably perform functions for a long time.

As above, the preferred exemplary embodiment of the present invention is described only as an example. However, the present invention is not limited thereto and may be modified and implemented in various ways, and further, it is apparent that the technical features may be added based on the technical spirit and ideas disclosed herein.

What is claimed is:

1. A wet leather stretching device, comprising:

a stand part (5) provided with an up-and-down vibration block (6);

first and second brackets (11, 12) respectively provided on left and right upper parts of the stand part (5);

first and second lower rollers (13, 14) respectively disposed on the first and second brackets (11, 12);

a head part (2) spaced apart from the up-and-down vibration block (6) by a predetermined distance;

first and second upper rollers (21, 22) respectively provided on left and right sides of the head part (2);

a first belt (17) moving in orbit between the first and second lower rollers (13, 14) while maintaining constant tension;

a second belt (27) moving in orbit between the first and second upper rollers (21, 22) while maintaining constant tension and facing the first belt (17);

a first pressing plate (18) provided with a plurality of pressure pins to tightly press against a lower surface of the first belt (17) in a state of being exposed through an upper surface of the up-and-down vibration block (6); and a second pressing plate (28) provided with a plurality of pressure pins to tightly press against an upper surface of the second belt (27) in a state of being exposed through a lower surface of the head part (2), wherein the second bracket (12) is provided with a mechanism for adjusting tension of the first belt (17), and the mechanism for adjusting the tension comprises:

a pair of movable plates (41), each coupled to each of left and right side surfaces of the second bracket (12);

a pair of support plates (31), each coupled to one surface of each movable plate (41);

a pair of cylinders (32), each having a lower part fixedly coupled to one surface of a lower part of each support plate (31);

a pair of rods (33), each protruding a certain length through an upper part of each cylinder (32);

two pairs of guide ends (35), each pair provided on one surface of each movable plate (41) at a predetermined distance above each support plate (31);

a pair of guide plates (36), each having a lower part connected to each rod (33), and having left and right side parts contacted with the guide end (35); and a movable pipe (37) with a predetermined length, while being in contact with the first belt (17) and having both end parts rotatably coupled to one guide plate (36) and the other guide plate (36) respectively.

2. The wet leather stretching device of claim 1, wherein a plurality of through-holes (371) is provided in the movable pipe (37), and any one of the guide plates (36) is connected to an air supply pipe (38) communicating with an end of the movable pipe (37).

3. The wet leather stretching device of claim 1, wherein both end parts of each of the second lower roller (14) and the second upper roller (22) are provided to be spaced apart from each other on an upper part of each movable plate (41), first and second guide holes (122, 123) having a predetermined length and positioned at different vertical heights are provided on each the left and right side surfaces of the second bracket (12), third and fourth through-holes (42, 43) having a predetermined length and positioned at different vertical heights are provided on each of the movable plates (41) in correspondence to each of the first and second guide holes (122, 123), and each movable plate (41) is adjusted by a predetermined width in forward and backward directions on each of the left and right side surfaces of the second bracket (12) by each of first and second fastening pins (44, 45) and is coupled to the second bracket (12).

4. The wet leather stretching device of claim 2, wherein both end parts of each of the second lower roller (14) and the second upper roller (22) are provided to be spaced apart from each other on an upper part of each movable plate (41), first and second guide holes (122, 123) having a predetermined length and positioned at different vertical heights are provided on each the left and right side surfaces of the second bracket (12), third and fourth through-holes (42, 43) having a predetermined length and positioned at different vertical heights are provided on each of the movable plates (41) in correspondence to each of the first and second guide holes (122, 123), and each movable plate (41) is adjusted by a predetermined width in forward and backward directions on each of the left and right side surfaces of the second bracket (12) by each of first and second fastening pins (44, 45) and is coupled to the second bracket (12).

* * * * *